US009180323B2

(12) United States Patent
Borchardt

(10) Patent No.: US 9,180,323 B2
(45) Date of Patent: Nov. 10, 2015

(54) FALL PROTECTION TIE-OFF ANCHOR POINT AND METHOD

(71) Applicant: Mark A Borchardt, Seattle, WA (US)

(72) Inventor: Mark A Borchardt, Seattle, WA (US)

( * ) Notice: Subject to any disclaimer, the term of this patent is extended or adjusted under 35 U.S.C. 154(b) by 0 days.

(21) Appl. No.: 14/533,605

(22) Filed: Nov. 5, 2014

(65) Prior Publication Data

US 2015/0196785 A1 Jul. 16, 2015

Related U.S. Application Data

(60) Provisional application No. 61/900,204, filed on Nov. 5, 2013.

(51) Int. Cl.

| | |
|---|---|
| ***E04B 1/00*** | (2006.01) |
| ***E04G 23/00*** | (2006.01) |
| ***A62B 35/00*** | (2006.01) |
| ***E04B 5/00*** | (2006.01) |
| *E04C 3/294* | (2006.01) |
| *E04B 1/24* | (2006.01) |
| *E04B 1/30* | (2006.01) |
| *E04B 5/40* | (2006.01) |

(52) U.S. Cl.

CPC ..... *A62B 35/0068* (2013.01); *E04B 5/00* (2013.01); *E04B 1/30* (2013.01); *E04B 5/40* (2013.01); *E04B 2001/2415* (2013.01); *E04B 2001/2421* (2013.01); *E04B 2001/2445* (2013.01); *E04C 3/294* (2013.01)

(58) Field of Classification Search

CPC ..... E04B 1/30; E04B 5/40; E04B 2001/2445; E04B 2001/2415; E04B 2001/2421; E04C 3/294

USPC ..... 52/27, 700, 702, 704, 712, 713, 334, 52/331, 321, 333, 351, 600, 603, 745.21; 182/150, 82, 3, 36, 142; 248/499, 237

See application file for complete search history.

(56) References Cited

U.S. PATENT DOCUMENTS

| | | | | | |
|---|---|---|---|---|---|
| 3,769,774 | A * | 11/1973 | Barnes | E04B 1/4157 | 248/58 |
| 3,860,089 | A * | 1/1975 | Huggett | A62B 35/04 | 182/36 |
| 4,507,901 | A * | 4/1985 | Carroll | E04B 7/00 | 52/220.1 |
| 5,343,975 | A * | 9/1994 | Riches | A62B 35/0056 | 104/115 |
| 5,456,443 | A * | 10/1995 | Taaffe | E05B 73/0005 | 248/499 |
| 5,730,407 | A * | 3/1998 | Ostrobrod | A62B 35/0043 | 182/231 |
| 5,937,602 | A * | 8/1999 | Jalbert | E01C 9/001 | 404/37 |
| 6,227,329 | B1 * | 5/2001 | Ador | A62B 35/0056 | 182/3 |
| 6,260,661 | B1 * | 7/2001 | Cutter | A62B 35/0068 | 182/36 |
| 7,624,550 | B2 * | 12/2009 | Ospina | E04B 1/161 | 52/262 |
| 2003/0006094 | A1 * | 1/2003 | Cole | A62B 35/0056 | 182/3 |
| 2004/0134312 | A1 * | 7/2004 | Hodges | B25D 1/16 | 81/27 |
| 2005/0257446 | A1 * | 11/2005 | Wolner | A62B 35/0068 | 52/127.1 |

* cited by examiner

*Primary Examiner* — Chi Q Nguyen

(74) *Attorney, Agent, or Firm* — Dean A. Craine; Marisa C. Whitaker

(57) ABSTRACT

An anchor point and method for creating an anchor point in a metal composite deck. The anchor point is made by inserting a connector plate into a slot opening formed in the metal corrugated panel used to make a metal composite deck. The connector plate is a flat, elongated bar with two opposite ends. Formed on the upper end is a first opening designed to receive a structural rebar or an ancillary rebar member attached to the-structural rebar that becomes imbedded into the composite deck. Formed on the lower end of the connector plate is a second opening designed to connect to a suitable D-ring connector plate or clip used by a construction worker when working under the deck and installing fixtures to the bottom surface of the metal composite deck.

2 Claims, 4 Drawing Sheets

FALL PROTECTION TIE-OFF ANCHOR POINT AND METHOD

This utility patent application is based on and claims the priority date benefit of U.S. Provisional Patent Application (Application No: 61/900,204) filed on Nov. 5, 2013.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to apparatus and methods for fall prevention tie off anchor points for metal composite decks.

2. Description of the Related Art

Many buildings are made of poured metal composite decks that use lower metal corrugated panels as forms over which wet concrete is poured. After curing, the metal corrugated panels remain in place providing a clean, attractive surface upon which plumbing and electrical fixtures and suspended ceiling connector plates may be attached.

Ideally, what is needed are inexpensive, easy to install fixed connector plates that are imbedded into the metal composite deck and used as a tie off anchor point that connect to fall prevention system worn by workers or as an end tie-off anchor point that connects to a lifeline for individual.

SUMMARY OF THE INVENTION

A drop through connector plate designed to fit into a slot opening formed in the lower metal corrugated panel used to make a metal composite deck. The connector plate is inserted into the slot opening formed into the lower metal corrugated panel and connected to structural rebar member assembled inside the forms used to construct the composite deck. The lower end of the connector plate extends through the slot opening and is exposed below the metal corrugated panel which may act as a ceiling anchor point for workers located below the composite deck.

The connector plate is a flat thin elongated structure made of metal or other composite material meeting the OSHA 5000 lb. requirement for anchor points. The length and width of the connector plate may vary and depends on the required structural thickness of the composite deck where the anchor point is installed. The connector plate includes an upper end and a lower end. Formed near the upper end is a first opening designed to receive a rebar member used on the structural frame or cage assembled inside the form and ever above the metal corrugated panel. If the existing rebar member is are not located in the desired location to be inserted into the first opening, a short ancillary rebar member may be inserted into the first opening and tied to the existing rebar member. The upper ends of the connector plate, the ancillary rebar member are later covered with concrete.

Formed on the second end of the connector plate is a second opening designed to selectively attach a suitable D-ring connector plate or locking clip on the end of a fall resistant cable used by a construction worker when working under the composite deck. When assembling the metal composite deck, a plurality of slot openings are spaced apart and formed on the metal corrugated panel at desired locations. A connector plate is then inserted into each slot so the upper end of the connector plate extends above the metal corrugated panel so that the first opening connects to the structural rebar member or to the ancillary rebar member. The length of the connector plate and the location of the connection point for the first opening must be sufficient so the first end of the connector plate has at least one inch of concrete coverage when the deck is poured. Ideally, the second end of the connector plate should extend at least three inches below the metal corrugated panel.

In one embodiment, the connector plate accommodates 5,000 lbs of tensile stress. In another embodiment, the connector plate is thicker to accommodate up to 10,000 lbs of tensile stress.

DESCRIPTION OF THE PREFERRED EMBODIMENT(S)

Figure 1:
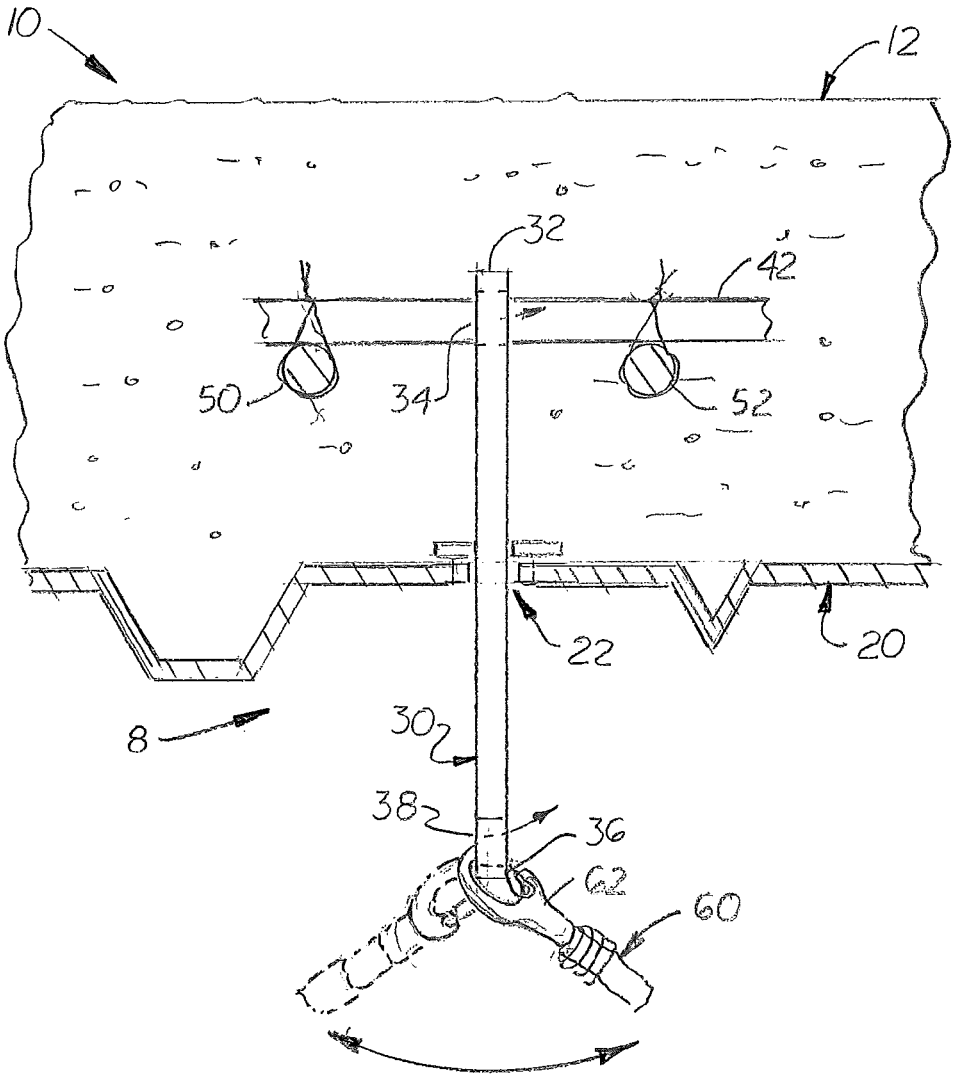
FIG. 1 is a sectional front elevational view of a section of a composite metal deck with the upper portion of a connector plate extended through slot formed on the lower metal corrugated panel and the lower portion extending below the lower metal corrugated panel with a safety strap attached to the lower end of the connector plate.
Figure 2:
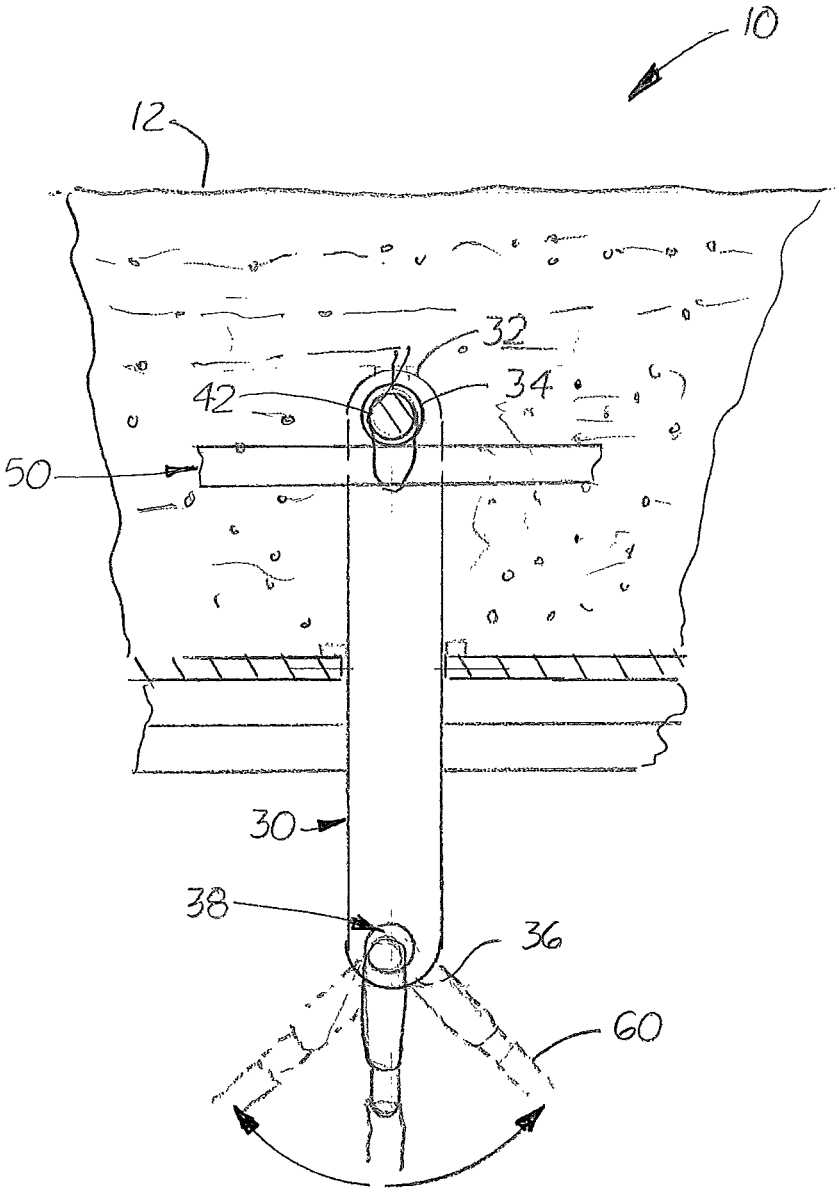
FIG. 2 is a sectional side elevational view of the section of composite metal deck shown in FIG. 1.

A fall protection tie-off anchor point 8 created on a metal composite deck 10 that includes using a flat bar-like connector plate 30 that fits into a slot opening 22 formed in the metal corrugated panel 20 used to manufacture a metal composite deck 10. The slot opening 22 is formed into the metal corrugated panel 20 at a desired location for a ceiling anchor, the connector plate 30 is inserted into the slot opening 22 and tied to a structural rebar member (not shown) or to a single ancillary rebar member 42 prior to pouring the concrete 12. The upper end of the connector plate 30 and the ancillary rebar member 42 are then covered with wet concrete 12.

The connector plate 30 is a flat thin metal or other composite material meeting the OSHA 5000 lb. requirement for anchorage points. The lengths of the connector plate 30 vary in length depending on the required structural thickness of the composite deck 10 being constructed. The connector plate 30 includes an upper end 32 and a lower end 36. Formed on the upper end 32 is a first opening 34 designed to receive a structural rebar 50, 52 or a short ancillary rebar bar 42 that connects to the surrounding pieces of structure rebar 50, 52 all located inside the cured the deck 10 and above the metal corrugated panel 20. Formed on the second end 36 of the connector plate 30 is a second opening 38 designed to connect to a suitable end D-ring connector plate 62 attached to the end of a safety strap 60 by a construction worker when working under the deck 10 and installing fixtures.

When assembling the metal composite deck 10, a plurality of slot openings 22 are spaced apart and formed on the metal corrugated panel 20 at desired locations. A connector plate 30 is then inserted into each slot opening 22 so the upper end 32 of the connector plate 30 extends above the metal corrugated panel 20 and the ancillary bar 42 is inserted into the first opening 34. The ancillary rebar member 42 is tied to horizontal structural rebar 50, 52 used to make the structural frame or cage inside the composite deck 10. Sometimes, the ancillary rebar member 42 may be eliminated and one of the structural rebar 50 or 52 is extended through the first opening 34. After assembly, the opposite second end 38 of the connector plate 30 protrudes below the composite deck 10 for easy access by a worker to attach any kind of personal fall protection device.

The slot opening 22 may be made in the metal corrugated panel 20 with a grinder, zip disc, acetylene cutting torch or punch.

The both ends 32 and 36 or just the second end 36 may be painted safety orange. Due to their flat configuration carpenters, ironworkers or laborers can carry them and the support bars easily in their bags a bucket or a box.

Figure 3:
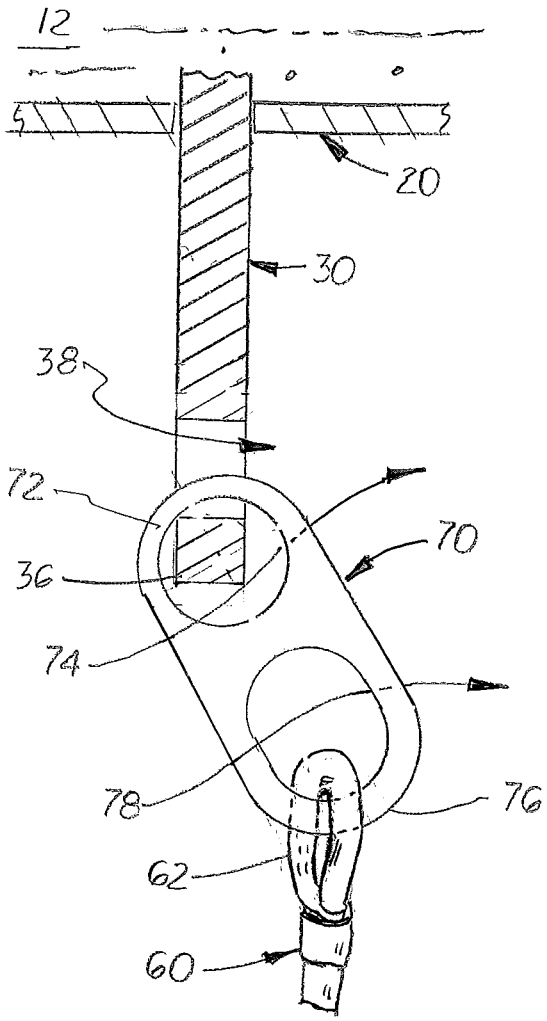
FIG. 3 is a sectional front elevational view of the connector plate showing an optional intermediate swivel element attached to the second opening near the lower end of the connector plate to which a safety strap is connected.

FIG. 3 is a sectional front elevational view of the connector plate 30 extending below a composite deck with an optional intermediate swivel element attached to the second opening The swivel element is a flat bar with an upper opening and a lower opening formed on its opposite ends. The upper opening is attached to the second opening 38 formed on the connector plate 30. The lower opening may be attached to a safety strap.

Figure 4:
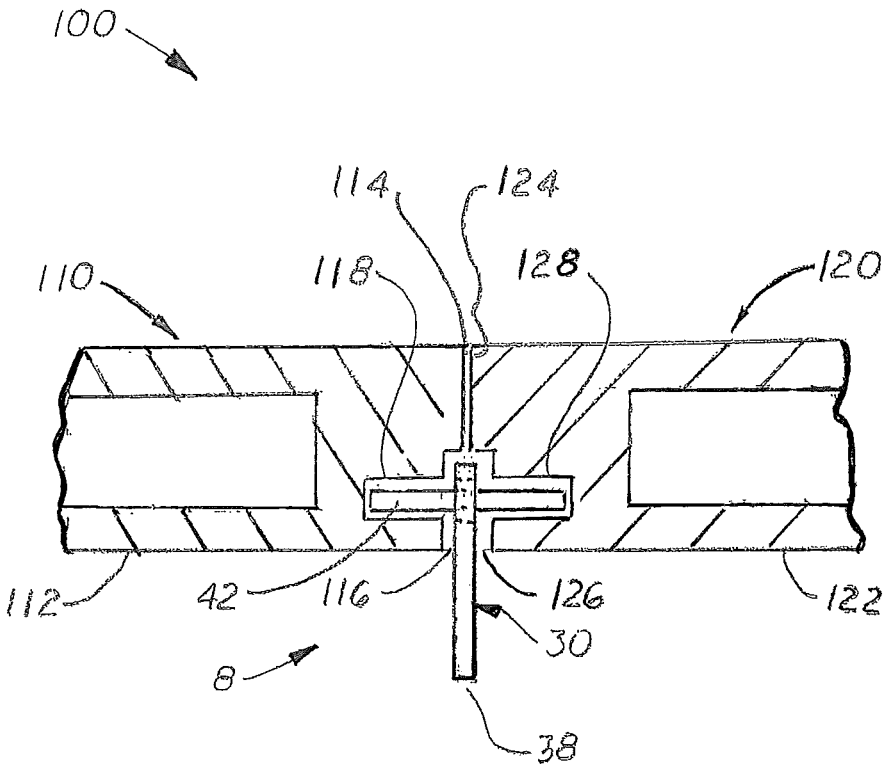
FIG. 4 is a side elevational view of the connector plate supported by an ancillary rebar member extending between two hollow core planks.

It should be understood that the connector plate 30 can also be used in a hollow core plank system 100 with minor preliminary prep work done by the plank supplier or it could be done onsite. As shown in FIG. 4, on two adjoining planks 110, 120, a small notch 116, 126 (approximately 2 to 3 inches in width and height) is formed each end surface 114, 124, respectively. The notches 116, 126 extend downward and intersect with the plank's bottom surface 112, 122, respectively. Small holes 118, 128 may be formed on the ends surfaces 114, 124, respectively, configured to receive an ancillary rebar 42.

During assembly, a hollow core first plank 110 is set in a final position in the building. A connector plate 30 is inserted into one of the notches 116. An ancillary rebar 42 is then inserted into small hole 118 on the first plank 110 and through the first opening 32 formed on the connector plate 30. The adjoining second plank 120 is then aligned with so its notch 126 is aligned with the notch 116 on the first plank 110 and the exposed end of the ancillary rebar 42 may be inserted into the small hole 128 formed on the second plank 120. After assembly, the lower end 36 of the connector plate 30 is then extended through the notches 116, 126 and supported by the ancillary rebar member 42 extending between the two planks 110, 120.

Using the above connector plate 30, a method for manufacturing an anchor point in the ceiling of a building with floors made of metal composite decks 10 is disclosed comprising the following steps:

a. installing a metal corrugated panel 20 used to construct a metal composite deck 10 used as a floor in a building, said metal corrugated panel 20 includes at least one slot 22 formed therein;

b. assembling structural rebar 50, 52 over said metal corrugated panel 20 configured to be embedded in concrete when said metal composite deck 10 is formed;

c. selecting a flat elongated connector plate 30 with an upper end 32 and a lower end 36, said upper end 32 includes a first opening 34 and said lower end 36 includes a second opening 38;

d. inserting said connector plate 30 through said slot opening 22 so said upper end 32 is positioned above said metal corrugated panel 20 and said lower end 36 is positioned below said metal corrugated panel 20;

e. connecting said first opening 34 to said rebar 50, 52 or to an ancillary rebar member 42 tied to said rebar 50, 52; and, f. pouring wet concrete 12 over said metal corrugated panel 20 and covering said rebar 50, 52, said ancillary rebar member 42 and said upper end 32 of said connector plate 30.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A ceiling anchor point, comprising;

a. a composite metal deck made of concrete that includes a lower metal corrugated panel, and at least one structural rebar or ancillary rebar member located above said corrugated panel, and an upper concrete layer that covers said metal corrugated panel and surrounds said rebar member, said lower metal corrugated panel includes at least one slot opening; and;

b. an elongated flat connector plate that includes an upper end and a lower end, formed near said upper end is a first opening configured to receive said structural rebar or said rebar member, said connector plate includes a second opening near said lower end configured to connect to a suitable D-ring connector plate or clip used by a construction worker when working under the deck and installing fixtures to the bottom surface of the metal composite deck, said upper end of said connector plate is inserted into said slot and above said metal corrugated panel and said first opening receives said structural rebar or said rebar member and said lower end extends below said metal corrugated panel.

2. A method for manufacturing an anchor point in the ceiling of a building with floors made of metal composite decks, comprising the following steps:

a. installing a metal corrugated panel used to construct a metal composite deck to be used as a floor in a building, said metal corrugated panel includes at least one slot formed therein;

b. assembling a structural rebar or a ancillary rebar member over said metal corrugated panel;

c. selecting a flat elongated connector plate with an upper end and a lower end, said upper end includes a first opening and said lower end includes a second opening;

d. inserting said connector plate through said slot opening so said upper end is positioned above said metal corrugated panel and said lower end is positioned below said metal corrugated panel;

e. connecting said first opening to said rebar or to said ancillary rebar member; and, f. pouring wet concrete over said metal corrugated panel and covering said structural rebar or said ancillary rebar member and a portion of said connector plate that extends through said slot and above said metal corrugated panel.

* * * * *